US008425012B2

(12) United States Patent
Toda

(10) Patent No.: US 8,425,012 B2
(45) Date of Patent: Apr. 23, 2013

(54) LIQUID EJECTION RECORDING HEAD INCLUDING AN ELEMENT GENERATING ENERGY USED TO EJECT LIQUID AND METHOD OF MANUFACTURING THE SAME

(75) Inventor: Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 12/968,768

(22) Filed: Dec. 15, 2010

(65) Prior Publication Data

US 2011/0148987 A1 Jun. 23, 2011

(30) Foreign Application Priority Data

Dec. 21, 2009 (JP) ..... 2009-288819

(51) Int. Cl.
*B41J 2/05* (2006.01)

(52) U.S. Cl.
USPC ..... 347/58; 347/50; 347/63

(58) Field of Classification Search ..... 347/49–50, 347/56–59
See application file for complete search history.

(56) References Cited

U.S. PATENT DOCUMENTS 6,609,782 B2 8/2003 Mori
7,547,094 B2 * 6/2009 Kawamura et al. ..... 347/50

FOREIGN PATENT DOCUMENTS

JP 2002-19120 A 1/2002

* cited by examiner

*Primary Examiner* — Juanita D Jackson
(74) *Attorney, Agent, or Firm* — Canon U.S.A, Inc. IP Division

(57) ABSTRACT

A method includes preparing a liquid ejection recording head that includes a substrate including an element generating energy used to eject liquid, a first supporting portion supporting the substrate, a wiring member including a plurality of electrode leads connected to a plurality of electrode pads provided for the substrate, and a second supporting portion supporting the wiring member, the wiring member including a vent that communicates with a region defined by the substrate, the first supporting portion, and the electrode leads and also communicates with an atmosphere, applying a sealing member to surfaces of the electrode leads, and sucking air in the region through the vent to introduce the sealing member into the region.

10 Claims, 8 Drawing Sheets

LIQUID EJECTION RECORDING HEAD INCLUDING AN ELEMENT GENERATING ENERGY USED TO EJECT LIQUID AND METHOD OF MANUFACTURING THE SAME

BACKGROUND OF THE INVENTION

1. Field of the Invention

The present invention relates to a liquid ejection recording head included in a liquid ejection recoding apparatus that ejects liquid, on a recording medium, and a method of manufacturing the same.

2. Description of the Related Art

Lower-cost recording apparatuses are demanded in the market for liquid ejection recording apparatuses. To provide a lower-cost recording apparatus, the promotion of cost reduction of a liquid ejection recording head is effective because the percentage of the recording head relative to the total cost is high. Japanese Patent Laid-Open No. 2002-19120 discloses such a liquid ejection recording head.

In the configuration of the liquid ejection recording head disclosed in Japanese Patent Laid-Open No. 2002-19120, substrates are connected to a wiring member through leads. Such connection portions are sealed with two kinds of sealing members. A typical liquid ejection recording head is sealed with two kinds of sealing member in this way. The sealing member that seals upper portions of electrode leads is provided in order to protect the connection portions from liquid or external force, for example, contact with a recording medium. The sealing member, therefore, has to have a predetermined hardness and thickness. A sealing member having a relatively high viscosity can be used.

Lower portions of the electrode leads have to be sealed in order to protect the electrode leads from liquid. If a high-viscosity sealing member is used, the sealing member is difficult to spread on the lower portions of the electrode leads. Consequently, it is difficult to seal the electrode leads with no gap. Accordingly, a sealing member having a relatively low viscosity is typically used to seal the lower portions of the electrode leads.

As described above, the related-art liquid ejection recording heads are sealed with the two kinds of sealing members having different viscosities.

As described above, however, further reduction in the cost of the liquid ejection recording head is demanded. As for sealing with the two kinds of sealing members in the related art, the number of steps of applying the sealing members is increased because the two kinds of sealing members are used. Disadvantageously, this sealing is expensive.

Therefore, sealing may be performed using a single sealing member in a liquid ejection recording head. In this case, a sealing member having a relatively high viscosity is required to protect electrode leads. Upon sealing the electrode leads using only the high-viscosity sealing member as described above, the following problems have been found.

Since the viscosity of the sealing member is high, the sealing member is difficult to spread on lower portions of the electrode leads through the spaces therebetween. It is therefore difficult to apply the sealing member with no gap. A gap may be formed. In a heating step for hardening the sealing member, this gap expands due to heat, thus causing a problem.

If the sealing member could be applied with no gap, it takes long time until the sealing member spreads on the electrode leads with no gap because the viscosity of the sealing member is high. It is not suitable in terms of manufacturing cost.

SUMMARY OF THE INVENTION

According to an aspect of the present invention, a method includes preparing a liquid ejection recording head that includes a substrate including an element generating energy used to eject liquid, a first supporting portion supporting the substrate, a wiring member including a plurality of electrode leads connected to a plurality of electrode pads provided for the substrate, and a second supporting portion supporting the wiring member, the wiring member including a vent that communicates with a region defined by the substrate, the first supporting portion, and the electrode leads and also communicates with an atmosphere, applying a sealing member to surfaces of the electrode leads, and sucking air in the region through the vent to introduce the sealing member into the region.

According to another aspect of the present invention, a recording head includes a substrate that includes an element generating energy used to eject liquid, a first supporting portion that supports the substrate, a wiring member that includes a plurality of electrode leads connected to a plurality of electrode pads provided for the substrate, a second supporting portion that supports the wiring member, and a sealing member that seals connection portions between the electrode pads and the electrode leads, wherein the wiring member includes a vent that communicates with a region defined by the substrate, the first supporting portion, and the electrode leads, and also communicates with an atmosphere.

Further features of the present invention will become apparent from the following description of exemplary embodiments with reference to the attached drawings.

DESCRIPTION OF THE EMBODIMENTS

First Embodiment

A first embodiment of the present invention will be described below.

The entire configuration of a liquid ejection recording head according to the first embodiment of the present invention will be described with reference to FIGS. 1A and 1B. Referring to FIG. 1B, the liquid ejection recording head, indicated at 1300, includes a substrate 1100 including an element generating energy used to eject liquid (ink). The liquid ejection recording head 1300 further includes a flexible wiring member 1200 for connection between the main body of a recording apparatus and the substrate 1100. The substrate 1100 is accurately positioned relative to a first supporting portion 1301 of a housing, formed by, for example, resin injection molding, and is fixed to the first supporting portion 1301. The wiring member 1200 is supported by and fixed to a second supporting portion 1306 of the housing. The housing, serving as a supporting member, includes the first supporting portion 1301 and the second supporting portion 1306.

The first supporting portion 1301 of the housing has supply paths 1303 for supply of ink in a liquid container 1302 that contains liquid to the substrate 1100. The substrate 1100 is fixed to the first supporting portion 1301, electrode leads 1201 (see FIG. 3) of the wiring member 1200 are joined to electrode pads 1205 provided for the substrate 1100, and after that, such connection portions are sealed by a sealing member 1402. This step of sealing will be described in more detail later.

Figure 1A:
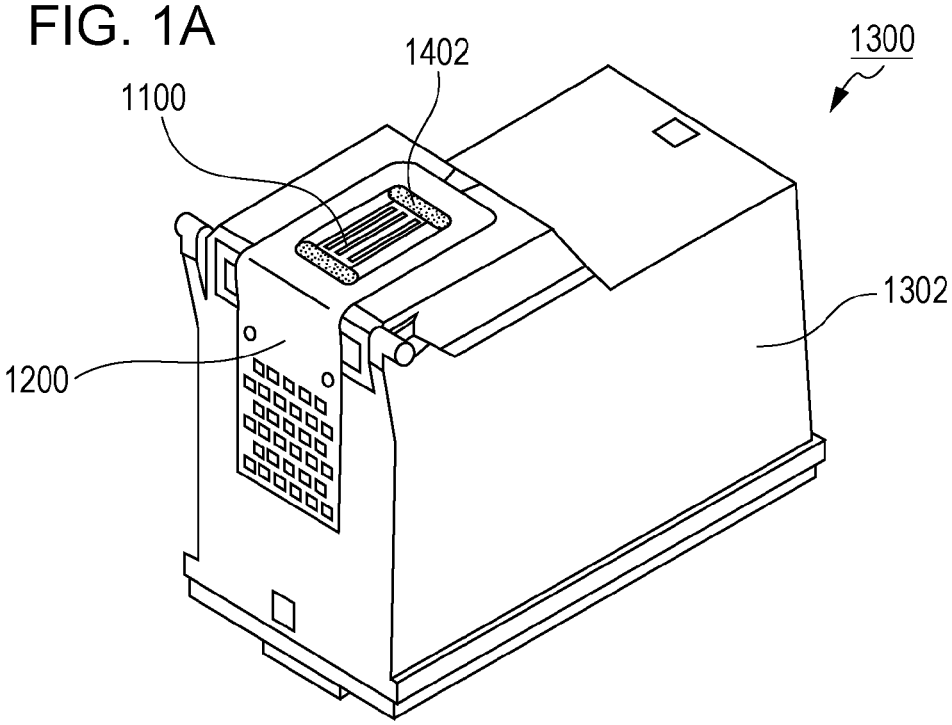
FIGS. 1A and 1B are perspective views of a liquid ejection recording head according to a first embodiment of the present invention.
Figure 1B:
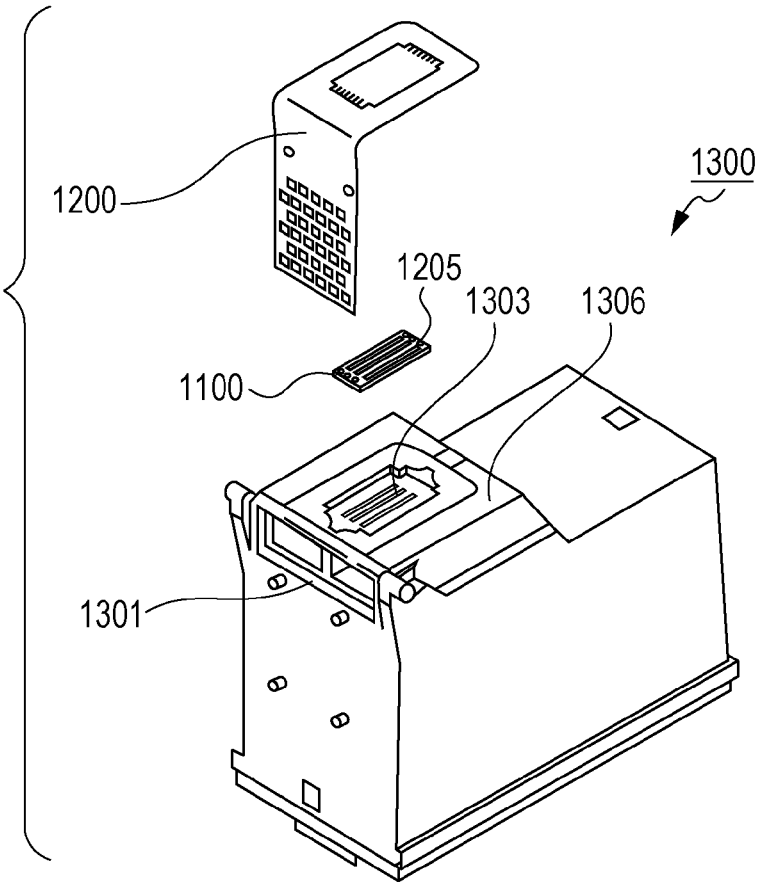
Figure 2:
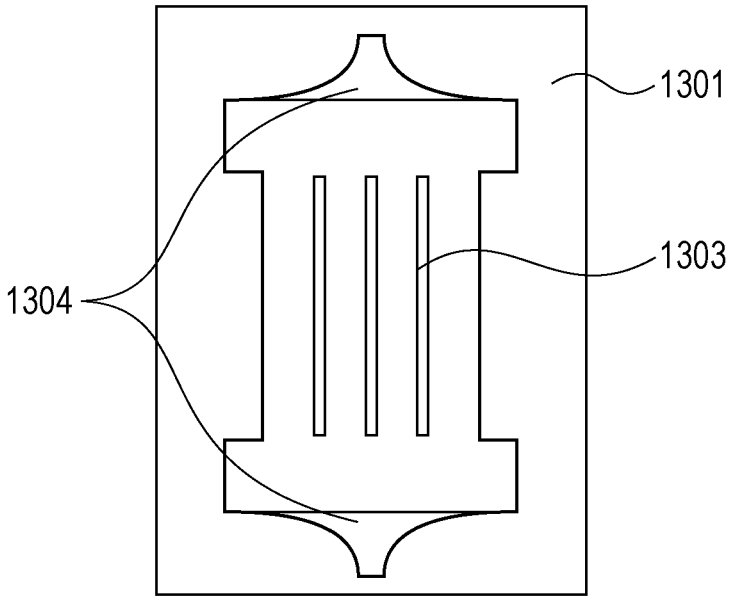
FIG. 2 is a diagram explaining the first embodiment of the present invention.

FIG. 2 is an enlarged view of an area including the first supporting portion 1301 in FIGS. 1A and 1B. FIG. 2 illustrates a state before the substrate 1100 is fixed. A groove 1304 constituting a passage for introducing the sealing member, which will be described later, is provided on each of the opposite ends in the longitudinal direction of an area where the substrate 1100 is to be fixed. The wiring member 1200 is bonded over the groove 1304, thus forming the passage, indicated at 1500, (second passage) (see FIG. 4B).

Figure 3:
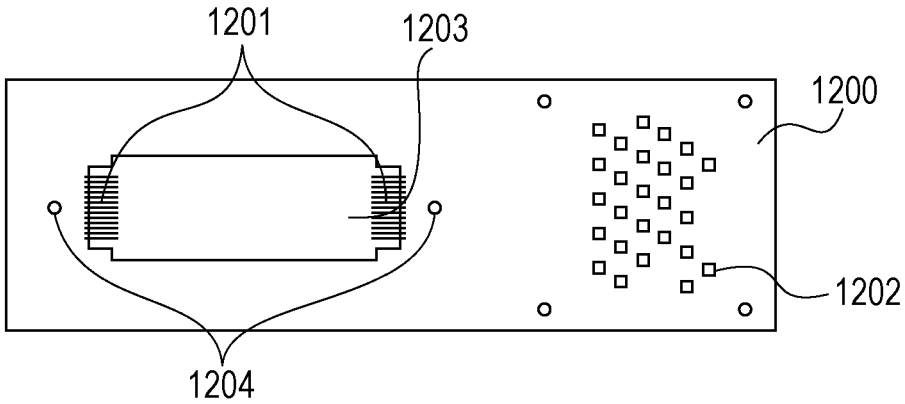
FIG. 3 is a diagram explaining the first embodiment of the present invention.

The wiring member 1200 will now be described with reference to FIG. 3. The wiring member 1200 includes an opening 1203 for placement of the substrate 1100, the electrode leads 1201 for connection to the electrode pads 1205 of the substrate 1100, and contact pads 1202 for connection to the main body of the recording apparatus. The passage 1500 is disposed in the vicinity of each of the arrangements of the electrode leads 1201 of the wiring member 1200. This passage 1500 communicates with a vent 1204 that communicates with an atmosphere. As will be described later, the air in the passage 1500 is sucked through the vent 1204 to reduce the pressure in the passage 1500, thus introducing the sealing member 1402. When the vents 1204 are provided in the wiring member 1200 as in the present embodiment, a sucking operation for introducing the sealing member 1402 by sucking nozzles 1601 can be easily performed. In addition, the degree of intimate contact of each sucking nozzle can be increased. The vents may be provided for the housing, serving as the supporting member.

Figure 4A:
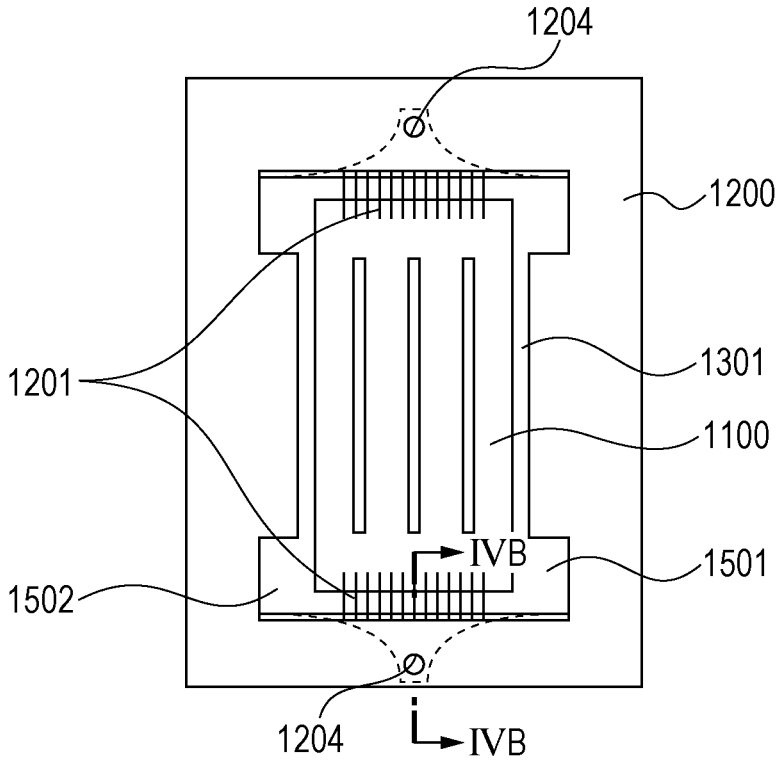
FIGS. 4A and 4B are diagrams explaining the first embodiment of the present invention.
Figure 4B:
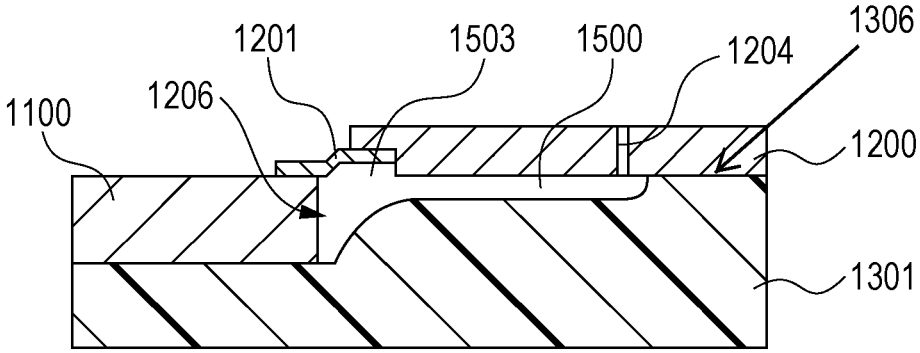

Referring to FIG. 4B, the substrate 1100 and the wiring member 1200 are bonded to the first supporting portion 1301 with an adhesive, thus forming a region 1206 defined by the electrode leads 1201, the substrate 1100, and the first supporting portion 1301. The region 1206 is to be applied with the sealing member 1402. The passage 1500 that connects the region 1206 to the vent 1204 is formed in the space between the first supporting portion 1301 and the wiring member 1200.

Figure 5A:
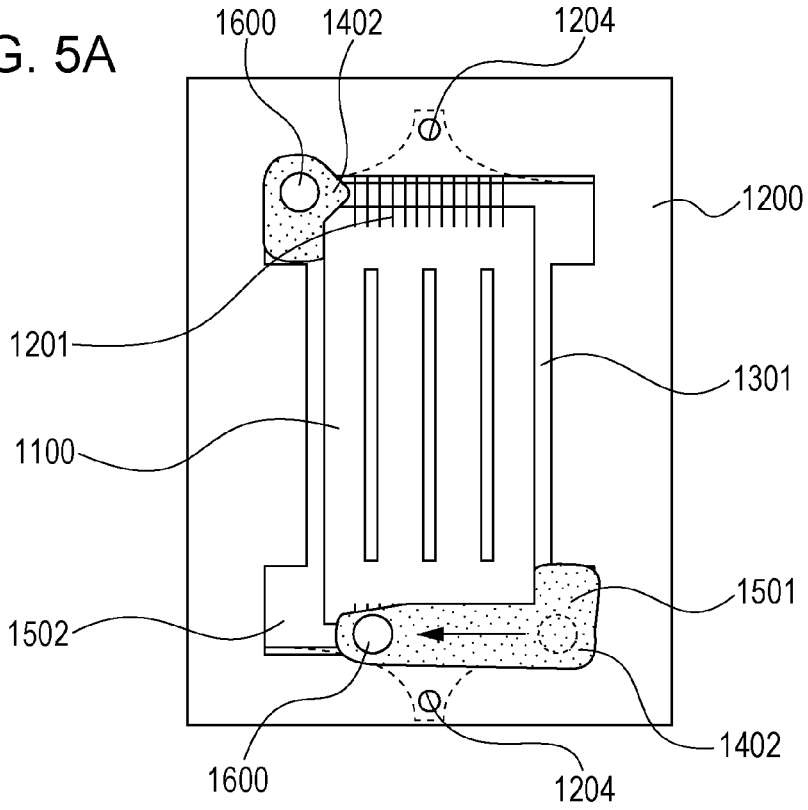
FIGS. 5A and 5B are diagrams explaining the first embodiment of the present invention.

The step of applying the sealing member 1402 in a process of manufacturing the recording head will now be described with reference to FIGS. 5A to 7. First, the recording head having the configuration described with reference to FIGS. 4A and 4B is prepared. Subsequently, a sealing-member applying nozzle 1600 for applying the sealing member 1402 is placed in the vicinity of one end of one arrangement of the electrode leads 1201 as illustrated in FIG. 5A. The sealing-member applying nozzle 1600 is moved to the other end of the arrangement of the electrode leads 1201 while being allowed to eject the sealing member 1402. Thus, the sealing member 1402 is applied to both ends of the arrangement of the electrode leads 1201 and the surfaces of the electrode leads 1201. As described above, the sealing member 1402 is first applied at least to the surfaces of the electrode leads 1201.

Similarly, the sealing member 1402 is applied to the other arrangement of the electrode leads 1201 in the substrate 1100. Applying the sealing member 1402 in the two positions may be performed in different steps. Alternatively, the sealing member 1402 may be applied in the two positions at the same time using two sealing-member applying nozzles 1600.

Figure 5B:
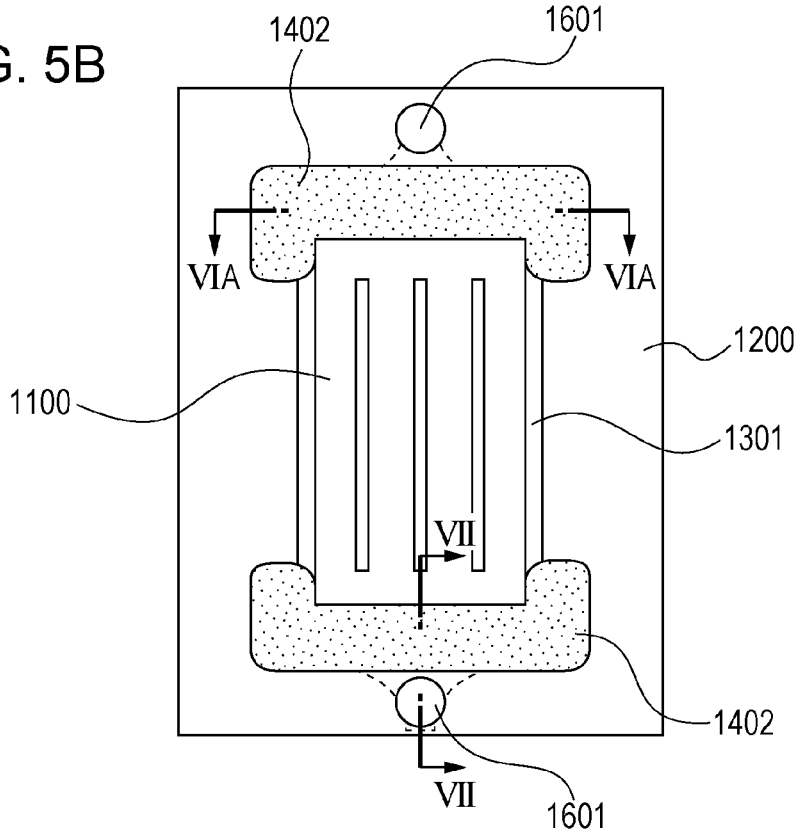
Figure 6A:
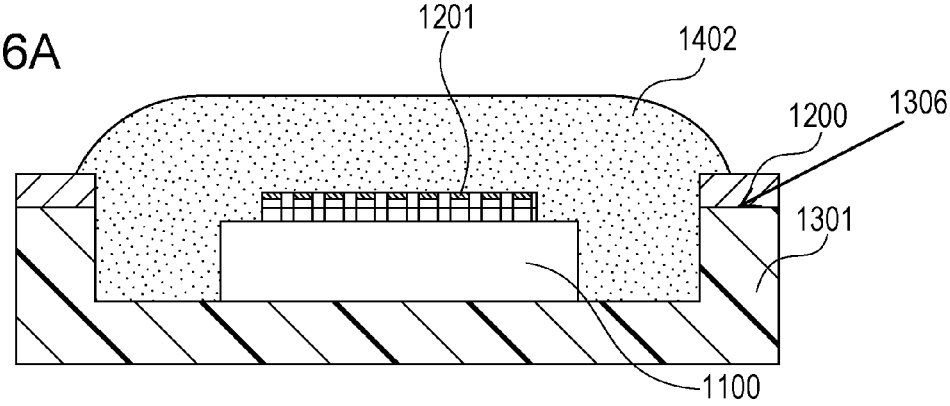
FIGS. 6A to 6C are diagrams explaining a step of applying a sealing member in the first embodiment of the present invention.
Figure 7:
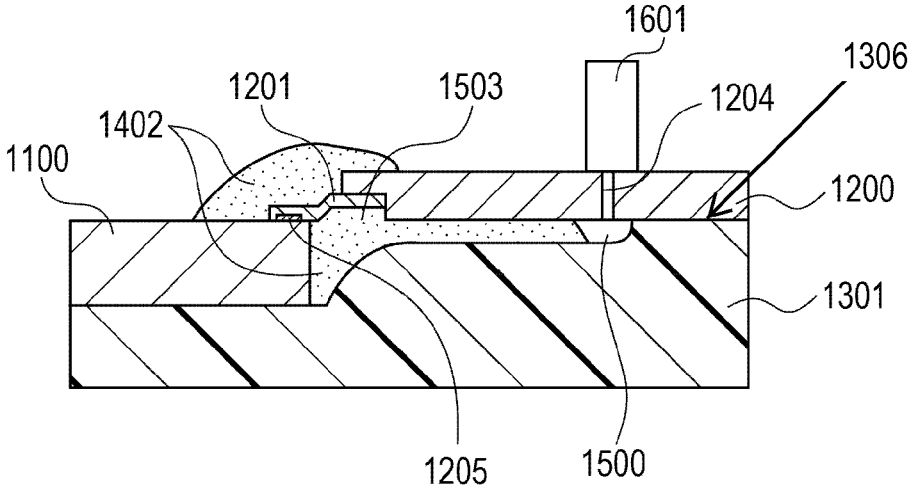
FIG. 7 is a diagram explaining the first embodiment of the present invention.

FIG. 5B illustrates a state in which the sealing member 1402 has been applied as described above. FIG. 6A is a cross-sectional view taken along the line VIA-VIA in FIG. 5B. Referring to FIG. 6A, the applied sealing member 1402 is mainly on side surfaces of the substrate 1100 and upper portions of the electrode leads 1201. The viscosity of the used sealing member 1402 is relatively high, i.e., about 250 Pa·s. Accordingly, the sealing member 1402 is difficult to fall into the spaces between the electrode leads 1201. From the viewpoint of protecting the connection portions, it is necessary to seal the connection portions between the electrode pads 1205 and the electrode leads 1201 and the entire electrode leads 1201 with the sealing member 1402. Accordingly, in the present embodiment, as illustrated in FIG. 7, the sucking nozzle 1601 is come into contact with the vent 1204 in the state illustrated in FIG. 6A to suck the air in the passage 1500, thus sucking the sealing member 1402 applied in the above-described region 1206.

Figure 6B:
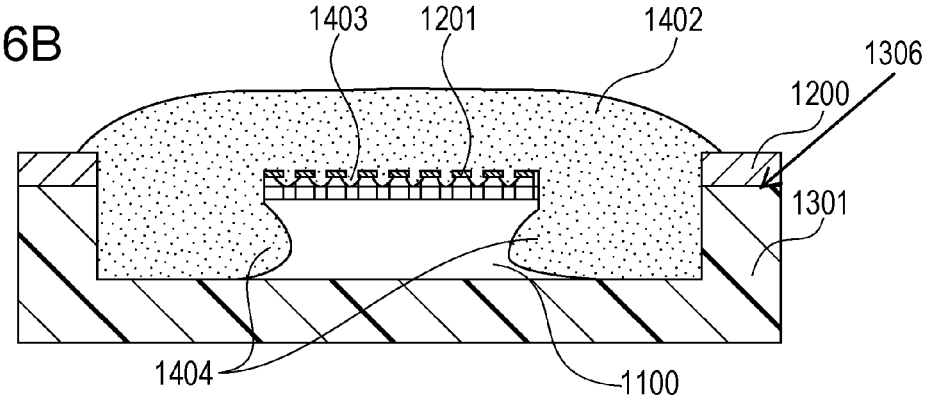
Figure 6C:
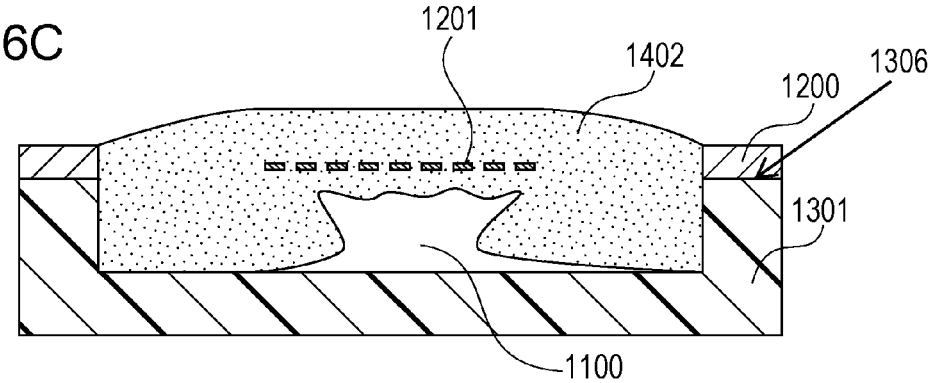

When the sucking nozzle 1601 starts sucking the air, the sealing member 1402 applied in the region 1206 starts moving to a middle of the arrangement of the electrode leads 1201 from both the ends as illustrated in FIG. 6B. Simultaneously with the movement of the sealing member 1402 to the middle, the sealing member 1402 breaks the menisci between the electrode leads 1201 and moves downward (see FIG. 6C). Thus, sealing member parts 1404 seal the entire electrode leads 1201. The above-described sucking through the vent 1204 introduces the sealing member 1402 into the region under the electrode leads 1201 and further introduces the sealing member 1402 into the passage 1500. FIG. 7 is a sectional view of this state taken along the line VII-VII in FIG. 5B.

As described above, the moving speed of the sealing member parts 1404 moving from the sides of the substrate 1100 to the middle of the arrangement of the electrode leads 1201 is higher than that of sealing member parts 1403 moving through the spaces between the electrode leads 1201. Accordingly, it is preferred to previously fill a space part 1501 and a space part 1502 near both the ends of each arrangement of the electrode leads 1201 with the sealing member 1402 whose amount corresponds to the volume of a space part under the electrode leads 1201. The space part under the electrode leads 1201 can be small to some extent in order to maintain the thickness of the sealing member 1402 and achieve stabilized sealing.

During the movement of the sealing member 1402 by sucking through the vent 1204, the sealing member 1402 may contain bubbles caused by, for example, flow disturbance. If the sealing member 1402 contains bubbles once, it is difficult to remove the bubbles because the viscosity of the sealing member 1402 is high. Therefore, the passage 1500 may have a curved opening portion 1503 that exhibits good flowability.

In the present embodiment, the opening portion 1503 of the passage 1500 is disposed at the farthest position from an area where the sealing member is first applied, namely, in the vicinity of the middle of the arrangement of the electrode leads 1201. Consequently, the region under the electrode leads 1201 can be filled with the sealing member while the sealing member 1402 is prevented from containing bubbles.

The wiring member 1200 and the substrate 1100 can be positioned on one side of the housing so that the amount of sealing member applied is varied depending on position. In this case, the opening portion 1503 is shifted (offset) to a position far from the area where the sealing member is first applied, so that the electrode leads 1201 can be more effectively sealed.

In addition, the passage 1500 partly includes a narrow space whose cross-sectional area is small. Accordingly, the sealing member 1402 is not further sucked due to a meniscus of the sealing member in the narrow space. Thus, the amount of sealing member sucked can be controlled. The passage 1500 can serve as a sensor for stopping the sucking through the vent 1204.

After the region under the electrode leads 1201 is sealed by the above-described sucking, the sealing member 1402 is hardened by heat treatment, thus forming the liquid ejection recording head. Upon observing liquid ejection recording heads made in this manner, it was confirmed that both of the upper and lower portions of each electrode lead 1201 were securely sealed with the sealing member 1402. It was also confirmed that the side portions of each electrode lead 1201 were sealed.

In some recording heads, it was found that a small amount of bubbles were contained in the sealing member 1402 near the join between the substrate 1100 and the first supporting portion 1301. However, the reliability of such a recording head did not present any problems because the bubbles were very small and the viscosity of the sealing member 1402 was high. As described above, even when a sealing member having a relatively high viscosity is used, the sealing member is applied to the ends of the arrangement of the electrode leads 1201 and the upper portions of the electrode leads 1201 and, after that, the air is sucked through the passage 1500 which communicates with the applied region and the vent 1204 which communicates with the atmosphere, so that the applied sealing member is forced to be sucked. Consequently, the sealing member can be spread over a predetermined region in a short time while the sealing member is prevented from containing bubbles.

Figure 8:
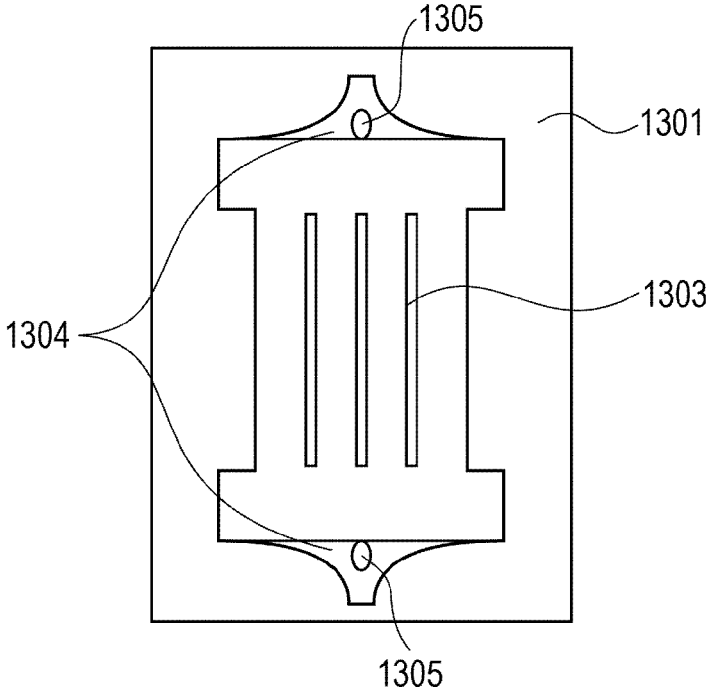
FIG. 8 is a diagram explaining the first embodiment of the present invention.

FIG. 8 illustrates a modification of the first embodiment. Referring to FIG. 8, an upright 1305 for supporting the wiring member 1200 is placed in each groove 1304 constituting the passage 1500 of the liquid ejection recording head 1300. In this liquid ejection recording head 1300, a plurality of paths communicating with the vent 1204 are arranged in the passage 1500. Thus, when the air is sucked through the vent 1204, the wiring member 1200 is prevented from falling into the passage 1500. It is suitable in terms of ensuring the cross-sectional area of the passage 1500.

When the substrate 1100 has a large width, the number of electrode leads is increased, so that an area which has to be sealed is also increased. In this case, a plurality of vents and a plurality of passages may be arranged because the sealing member can be uniformly applied to the entire area which has to be sealed. In the case where the vents and the passages are arranged, sucking may be performed by the sucking nozzle through a plurality of openings at once. Alternatively, sucking may be sequentially performed through the vents from the vent located at one end of the area to be sealed to the vent located at the middle of the area. In the sequential sucking, the vents which are not used for sucking may be hermetically sealed. So long as the order of vents used for sucking is determined, even if the area to be sealed is large, stable sealing can be achieved while the sealing member is prevented from containing bubbles.

Second Embodiment

A second embodiment of the present invention will be described with reference to FIGS. 9A and 9B.

Figure 9A:
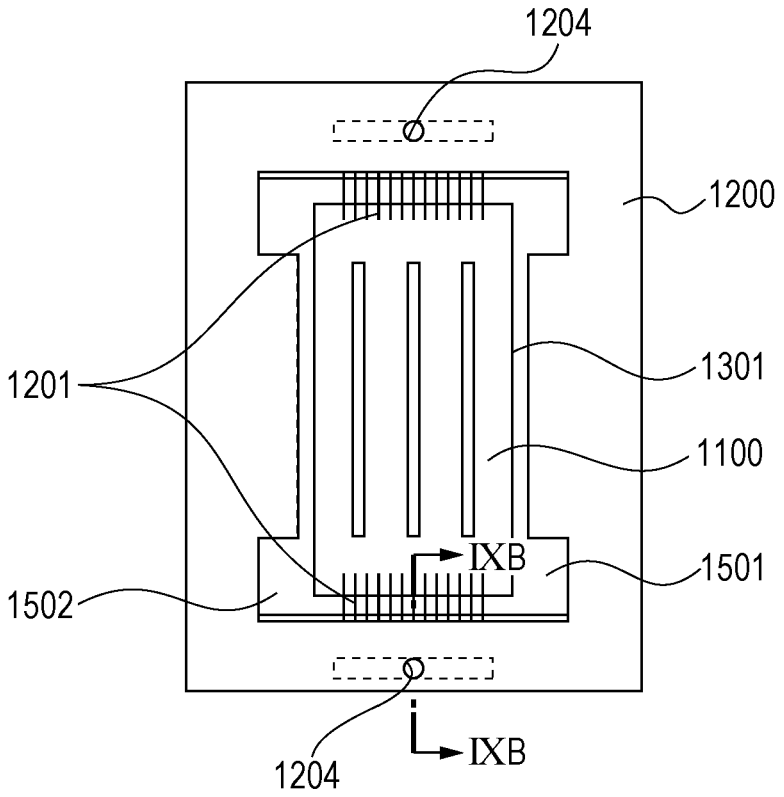
FIGS. 9A and 9B are diagrams explaining a second embodiment of the present invention.
Figure 9B:
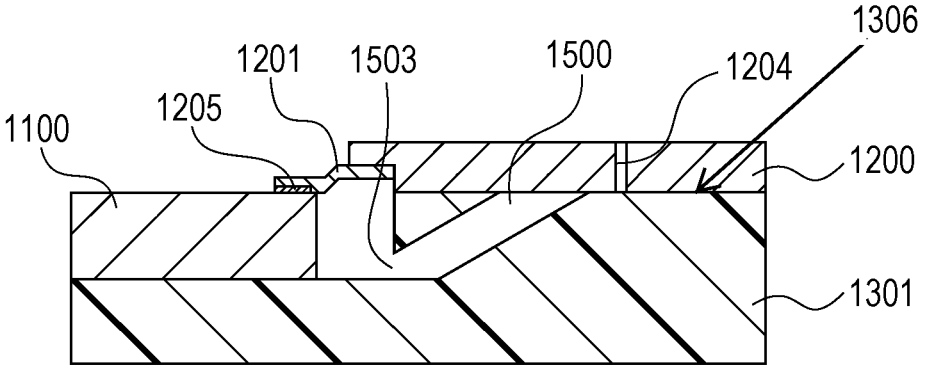

FIG. 9A is a plan view of the second embodiment. FIG. 9B is a sectional view taken along the line IXB-IXB in FIG. 9A. In this embodiment, each passage 1500 is included in the supporting member that includes the first supporting portion 1301. The formation of this passage is suitable because the passage can be formed simultaneously with the formation of the housing including the first supporting portion 1301 by, for example, injection molding.

According to this embodiment, the flexibility of placement of each vent 1204 is increased. In addition, since the passage 1500 is included in the supporting portion 1301, the wiring member 1200 can be supported by an upper wall of the passage 1500. It is suitable because the deformation of the wiring member 1200 can be prevented when air is sucked through the vent 1204.

Figure 10A:
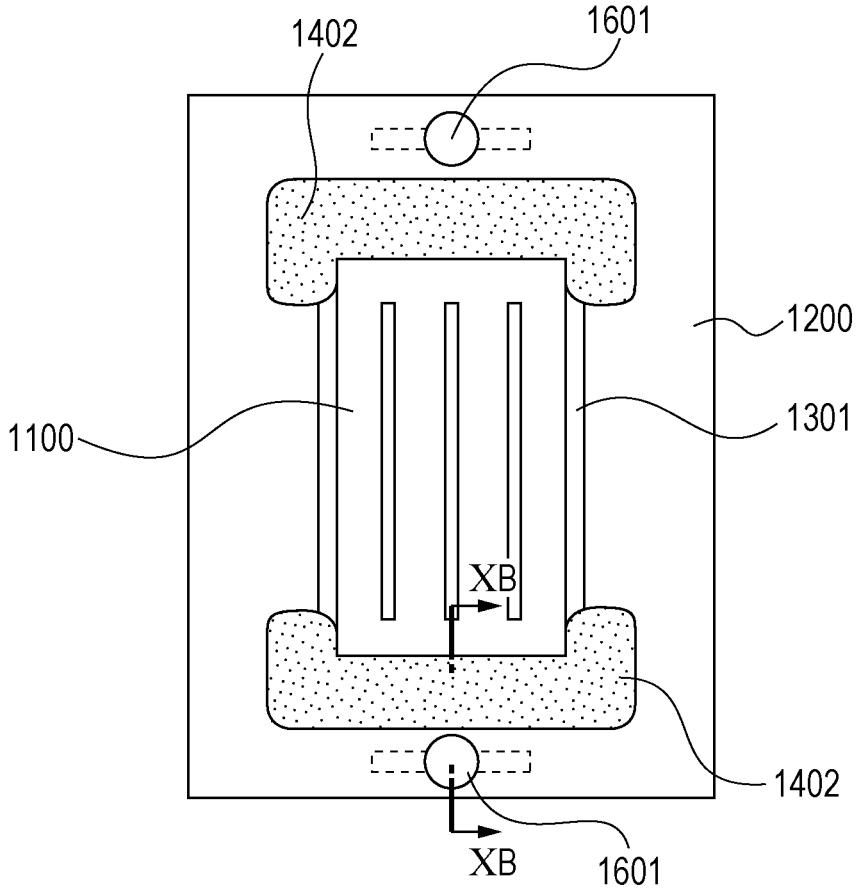
FIGS. 10A and 10B are diagrams explaining the second embodiment of the present invention.
Figure 10B:
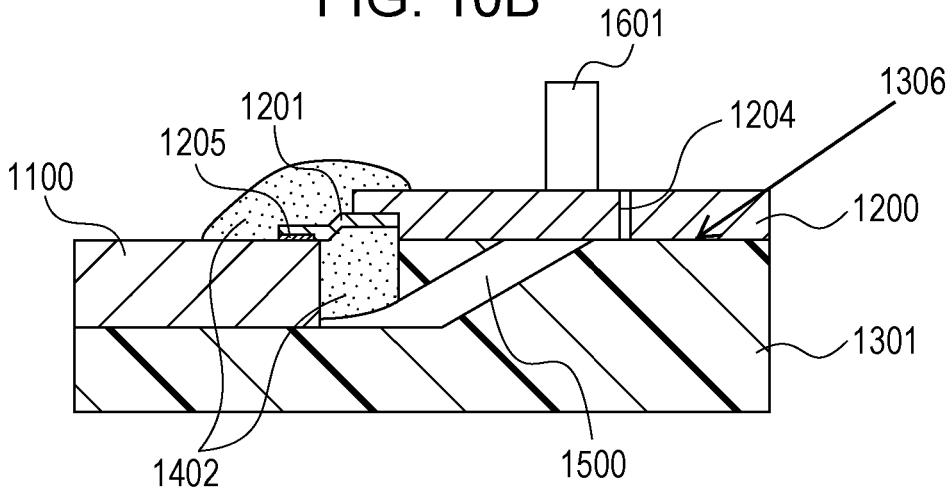

FIGS. 10A and 10B illustrate a modification of the second embodiment. Referring to FIGS. 10A and 10B, the cross-sectional area of an opening of the passage 1500 connected to the region to be sealed is designed to be minimized in the entire passage. Thus, when the sealing member 1402 is introduced into the region under the electrode leads 1201 by sucking the air through the vent 1204, the introduction of the sealing member can be stopped by a meniscus force in the entrance to the passage 1500 because the cross-sectional area of the entrance is small. Accordingly, the timing of stopping the sucking operation can be controlled with such a simple configuration. In addition, since the passage 1500 communicates with the atmosphere even after the step of sealing, the electrical reliability can be ensured.

In the configuration of FIGS. 10A and 10B, the opening, serving as the entrance to the passage 1500, is positioned near the bottom of the region under the electrode leads 1201. Consequently, bubbles remaining in the vicinity of the join between the substrate 1100 and the supporting portion 1301 are further reduced.

To remove ink clogging of ejection orifices in the liquid ejection recording head, a recovery operation of performing sucking while the entire substrate is covered with a cap is generally performed. If the vent 1204 is closed at this time, the sucking can be efficiently performed. Accordingly, the vent 1204 can be closed with the sealing member after the above-described step of sealing is completed.

The above-described embodiments have been described with respect to the case where only the connection portions and their surroundings are sealed with the sealing member. In the described configuration, the sealing member is not applied to longitudinal side surfaces of the substrate 1100. The configuration in which the sealing member is not provided on the side surfaces of the substrate is suitable because it can reduce the effect of stress on the substrate caused by the expansion or contraction of the sealing member with the change of temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-288819 filed Dec. 21, 2009, which is hereby incorporated by reference herein in its entirety.

What is claimed is:

1. A method comprising:

preparing a liquid ejection recording head that includes a substrate including an element generating energy used to eject liquid, a first supporting portion supporting the substrate, a wiring member including a plurality of electrode leads connected to a plurality of electrode pads provided for the substrate, and a second supporting portion supporting the wiring member, the wiring member including a vent that communicates with a region defined by the substrate, the first supporting portion, and the electrode leads and also communicates with an atmosphere;

applying a sealing member to surfaces of the electrode leads; and sucking air in the region through the vent to introduce the sealing member into the region.

2. The method according to claim 1, wherein the region excluding the vent is hermetically sealed by applying the sealing member to the surfaces of the electrode leads.

3. The method according to claim 1, wherein the second supporting portion includes a first passage that communicates with the region and the vent.

4. The method according to claim 3, wherein the sucking air is stopped after the sealing member is introduced into an opening of the first passage, the opening connecting to the region.

5. The method according to claim 1, wherein a second passage is defined between the wiring member and a groove on a surface of a supporting member including the first supporting portion and the second supporting portion, the second passage communicating with the vent.

6. A recording head comprising:

a substrate that includes an element generating energy used to eject liquid;

a first supporting portion that supports the substrate;

a wiring member that includes a plurality of electrode leads connected to a plurality of electrode pads provided for the substrate;

a second supporting portion that supports the wiring member;

a sealing member that seals connection portions between the electrode pads and the electrode leads;

a vent that is formed in the wiring member, communicates with a region defined by the substrate, the first supporting portion, and the electrode leads, and also communicates with an atmosphere; and a passage that is formed between the first supporting portion and the second supporting portion and communicates with the vent and the region.

7. The head according to claim 6, wherein the passage is defined by a hole formed through the second supporting portion.

8. The head according to claim 7, wherein an opening of the first passage connecting to the region is positioned in a middle of an area corresponding to an arrangement of the electrode leads.

9. The head according to claim 7, wherein the opening has a minimum cross-sectional area in the first passage.

10. The head according to claim 6, wherein the passage is defined between the wiring member and a groove on a surface of a supporting member including the first supporting portion and the second supporting portion.

* * * * *